US007628312B2

(12) United States Patent
Mittelstaedt et al.

(10) Patent No.: US 7,628,312 B2
(45) Date of Patent: Dec. 8, 2009

(54) STORAGE CONTAINER DEVICE

(76) Inventors: Chris Mittelstaedt, 405 Victory Dr., Suite D, South San Francisco, CA (US) 94080; Richard G. Hansen, 1999 Oak St., No. 4, San Francisco, CA (US) 94117; Kevin McKim, 4530 Leckron Rd., Modesto, CA (US) 95357; Erich Boese, 4530 Leckron Rd., Modesto, CA (US) 95357; Tony Joyce, 4530 Leckron Rd., Modesto, CA (US) 95357

( * ) Notice: Subject to any disclaimer, the term of this patent is extended or adjusted under 35 U.S.C. 154(b) by 559 days.

(21) Appl. No.: 11/305,487

(22) Filed: Dec. 15, 2005

(65) Prior Publication Data

US 2007/0138245 A1 Jun. 21, 2007

(51) Int. Cl.
*B65D 5/00* (2006.01)
*B65D 25/04* (2006.01)

(52) U.S. Cl. ..... 229/163; 229/165; 229/149; 229/177; 229/178; 229/120.36; 229/120.38

(58) Field of Classification Search ..... 229/163, 229/165, 149, 148, 150, 153, 177, 178, 179, 229/120.36, 120.38, 120.34
See application file for complete search history.

(56) References Cited

U.S. PATENT DOCUMENTS 1,976,530 A * 10/1934 Verhoven ..... 229/117.17
2,858,058 A * 10/1958 Kitchell ..... 229/149
3,752,349 A * 8/1973 Rana ..... 220/6
3,973,723 A * 8/1976 Owens ..... 229/143
4,469,272 A * 9/1984 McFadden et al. ..... 229/120.33
5,018,663 A * 5/1991 Corso ..... 229/117.13
5,392,985 A * 2/1995 Smith et al. ..... 229/125

* cited by examiner

*Primary Examiner*—Gary E Elkins
*Assistant Examiner*—Latrice Byrd
(74) *Attorney, Agent, or Firm*—Wiesner & Associates; Leland Wiesner

(57) ABSTRACT

Aspects of the present invention feature a storage container formed from cardboard material. This particular storage container has a rectangular base unit having a front wall folded upwardly along a folded front edge of the rectangular base, a back wall folded upwardly along a folded back edge of the rectangular base with at least one cover slot and integral cover secure flap extending from within the at least one cover slot. On the top of the storage container, a outer cover panel extension to the front wall is folded in a spaced and parallel relationship to the rectangular base along a folded top edge of the front wall and having at least one cover tuck flap with an integral cover secure slot both cooperating with the at least one cover slot and integral cover secure flap respectively. Under the cardboard outer cover panel is an inner cover panel extension to the back wall folded along a folded top edge of the back wall in a spaced and parallel relationship to the rectangular base. On the sides of the storage container is a pair of front side panels each extending laterally and inwardly along a scored side edge of the front wall and having side panel tab on the top edge of each front side panel. The sides are reinforced with a pair of back side panels each extending laterally and inwardly along a scored edge from a side edge of the back wall and having side panel tab on the top edge of each front side panel. Wrapping around these side panels is a pair of end walls each extending upwardly along a scored side edge of the rectangular base. An end wall has at least one slotted tab at the lower end of each end wall and an inner end wall extending along a double-scored top edge of each end wall folded inwardly and downwardly around the top end of each end wall and wrapping around a front side panel and a back side panel while having a slotted tuck flap extension designed with at least one slot to cooperate and lock into the at least one slotted tab at the lower end of each end wall.

5 Claims, 6 Drawing Sheets

STORAGE CONTAINER DEVICE

BACKGROUND

Storage containers are of growing importance in commerce as more products are being shipped to individual customers. Depending on the product being shipped, the storage container may need to be specially designed to both fit and protect the product. To ship fruits and other perishables, the containers need to protect the fruits from being damaged during shipping and handling. Also, the box needs to have sufficient strength to hold the heavier weight of the fruit and withstand stacking several containers upon each other without crushing from the overall weight.

Conventional boxes tend to use a variety of glues and plastic material together to provide protection needed for the shipping fruits and other products. These conventional boxes may be expensive to manufacture as they require several different packaging pieces to be manufactured separately and then assembled. Also, they tend not be easily broken down and recycled as they may have tough glues or nails holding them together. The glues and other fastening materials along with non-biodegradable packaging are hard to dispose of and may even be harmful to the environment in large enough quantities.

In particular, it is difficult to ship fruit as gifts in conventional boxes as they may look cheaply made and not aesthetically appealing. This is often not the impression desired when sending fruit or other perishables as a gift to be placed in a home kitchen or office environment. Unfortunately, the conventional storage containers that are capable of shipping fruit and perishables do not address these and other related issues.

BRIEF DESCRIPTION OF THE DRAWINGS

Like reference numbers and designations in the various drawings indicate like elements.

SUMMARY

Aspects of the present invention feature a storage container formed from cardboard material. This particular storage container has a rectangular base unit having a front wall folded upwardly along a folded front edge of the rectangular base, a back wall folded upwardly along a folded back edge of the rectangular base with at least one cover slot and integral cover secure flap extending from within the at least one cover slot.

On the top of the storage container, a outer cover panel extension to the front wall is folded in a spaced and parallel relationship to the rectangular base along a folded top edge of the front wall and having at least one cover tuck flap with an integral cover secure slot both cooperating with the at least one cover slot and integral cover secure flap respectively. Under the cardboard outer cover panel is an inner cover panel extension to the back wall folded along a folded top edge of the back wall in a spaced and parallel relationship to the rectangular base.

On the sides of the storage container is a pair of front side panels each extending laterally and inwardly along a scored side edge of the front wall and having side panel tab on the top edge of each front side panel. The sides are reinforced with a pair of back side panels each extending laterally and inwardly along a scored edge from a side edge of the back wall and having side panel tab on the top edge of each front side panel. Wrapping around these side panels is a pair of end walls each extending upwardly along a scored side edge of the rectangular base. An end wall has at least one slotted tab at the lower end of each end wall and an inner end wall extending along a double-scored top edge of each end wall folded inwardly and downwardly around the top end of each end wall and wrapping around a front side panel and a back side panel while having a slotted tuck flap extension designed with at least one slot to cooperate and lock into the at least one slotted tab at the lower end of each end wall.

DETAILED DESCRIPTION

Figure 1:
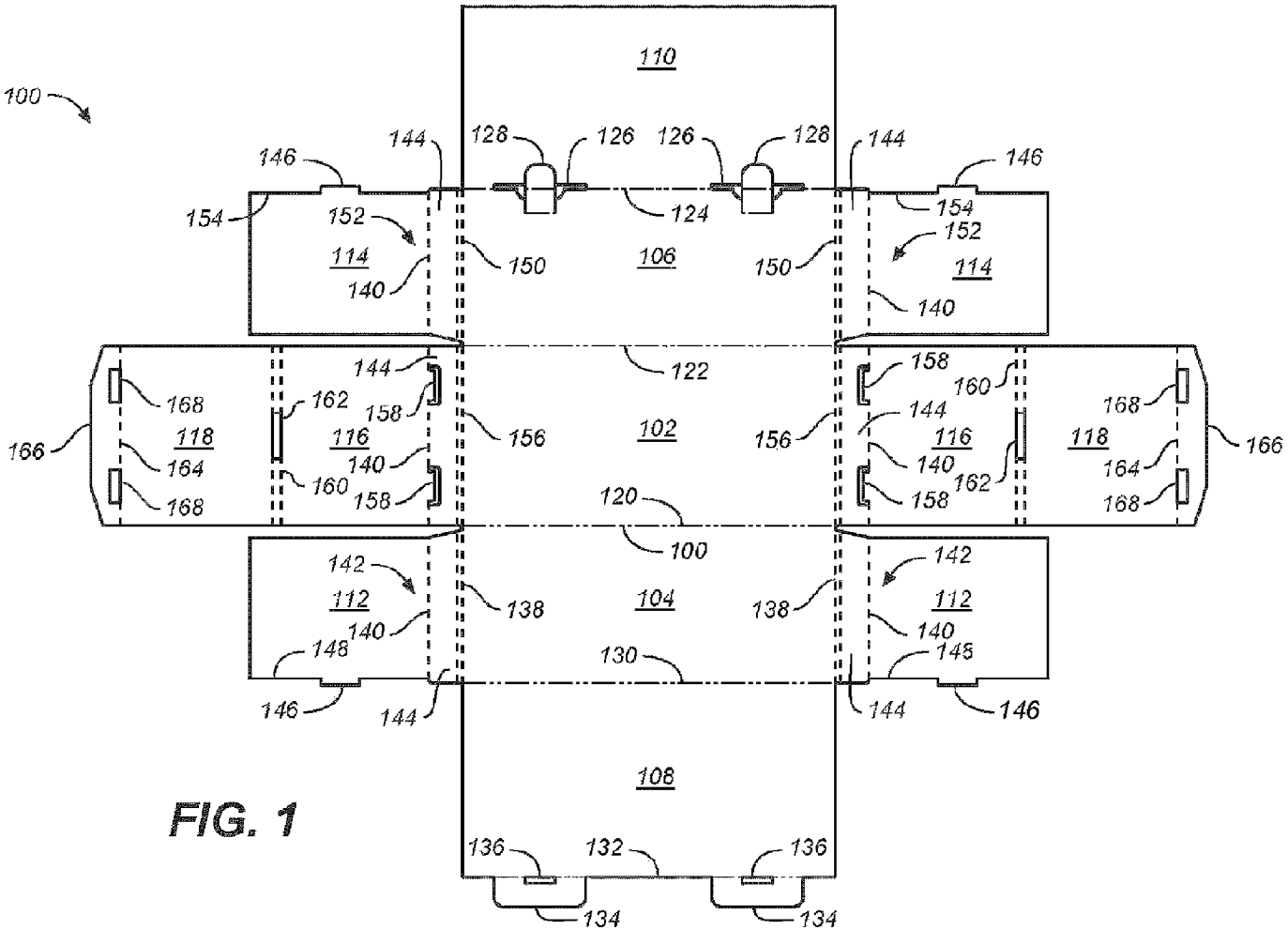
FIG. 1 is a storage container depicted in accordance with implementations of the present invention in an unassembled state.

Referring to FIG. 1, a storage container 100 is depicted in accordance with implementations of the present invention in an unassembled state. While it may be possible to glue one or more portions, storage container 100 has been designed to provide sufficient structural integrity and overall strength for shipping and handling without the need of glues or seals. Of course, other types of seals to indicate authenticity or tampering with the contents may be added as seen fit by the shipping or receiving party. With appropriate inserts, storage container 100 may be used for storing and shipping fruits or perishables as well as any other number of items.

Storage container 100 can be implemented using a single cardboard sheet having a rectangular base 102, a front wall 104, a back wall 106, an outer cover panel 108, an inner cover panel 110, a pair of front side panels 112, a pair of back side panels 114, a pair of end walls 116 and a pair of inner wall 118 extensions there from.

Rectangular base 102 is connected to front wall 104 by way of a fold along front edge 120. Similarly, rectangular base 102 is also connected to back wall 106 by way of another fold along back edge 122. At the top edge 124 of back wall 106 is at least one cover slot 126 and integral cover secure flap 128 that extends from within cover slot 126. Inner cover panel 110 extends from back wall 106 along a folded top edge 124. For example, the example implementation depicted in FIG. 1 includes a pair of cover slots 126 and a pair of integral cover secure flaps 128 however greater or fewer slots and flaps can also be used.

Outer cover panel 108 extends from front wall 104 by way of a folded top edge 130. Along the top edge 132 of outer cover panel 108 is at least one cover tuck flap 134 and integral cover secure slot 136 corresponding to the number of cover slots 126 and integral cover secure flaps 128 associated with back wall 106. For example, a pair of cover tuck flaps 134 and integral cover secure slots 136 is matched with the pair of cover slots 126 and integral cover secure flaps 128 in the example implementation in FIG. 1.

Front side panels 112 extend from side edges 138 of front wall 104 along a double-scored perforation to facilitate multiple flat folds of cardboard material. An additional scoring 140 is made between the side portions 142 of each front side panel 112 forming an inset panel 144. In addition, each of front side panels 112 has a side panel tab 146 extending from the top edge 148 of the front side panels 112.

Likewise, back side panels 114 extend from side edges 150 of back wall 106 also along double-scored perforations. To also provide for inset panels 144, additional scoring 140 is made between the side portions 152 of back side panels 114. Once again, each of back side panels 114 has a side panel tab 146 extending from the top edge 154 of back side panels 114.

Rectangular base 102 also has a pair of end walls 116 extending from side edge 156 along double-scored perforations. Each end wall 116 has at least one slotted tab 158 at the lower end of each end wall. For example, in FIG. 1 each end wall 116 has a pair of slotted tabs 158. Beyond end walls 116 are inner end walls 118 extended along a double-scored perforation 160 having a side tab slot 162 positioned there between the pair of perforations. At the top edge 164 of each of inner end walls 118 along a perforation is a slotted tuck flap extension 166 having at least one slot 168 and corresponding to the number of slotted tabs 158. For example, FIG. 1 depicts a pair of slots 168 along top edge 164 of inner end walls 118 to match the pair of slotted tabs 158 along additional scoring 140.

Figure 2A:
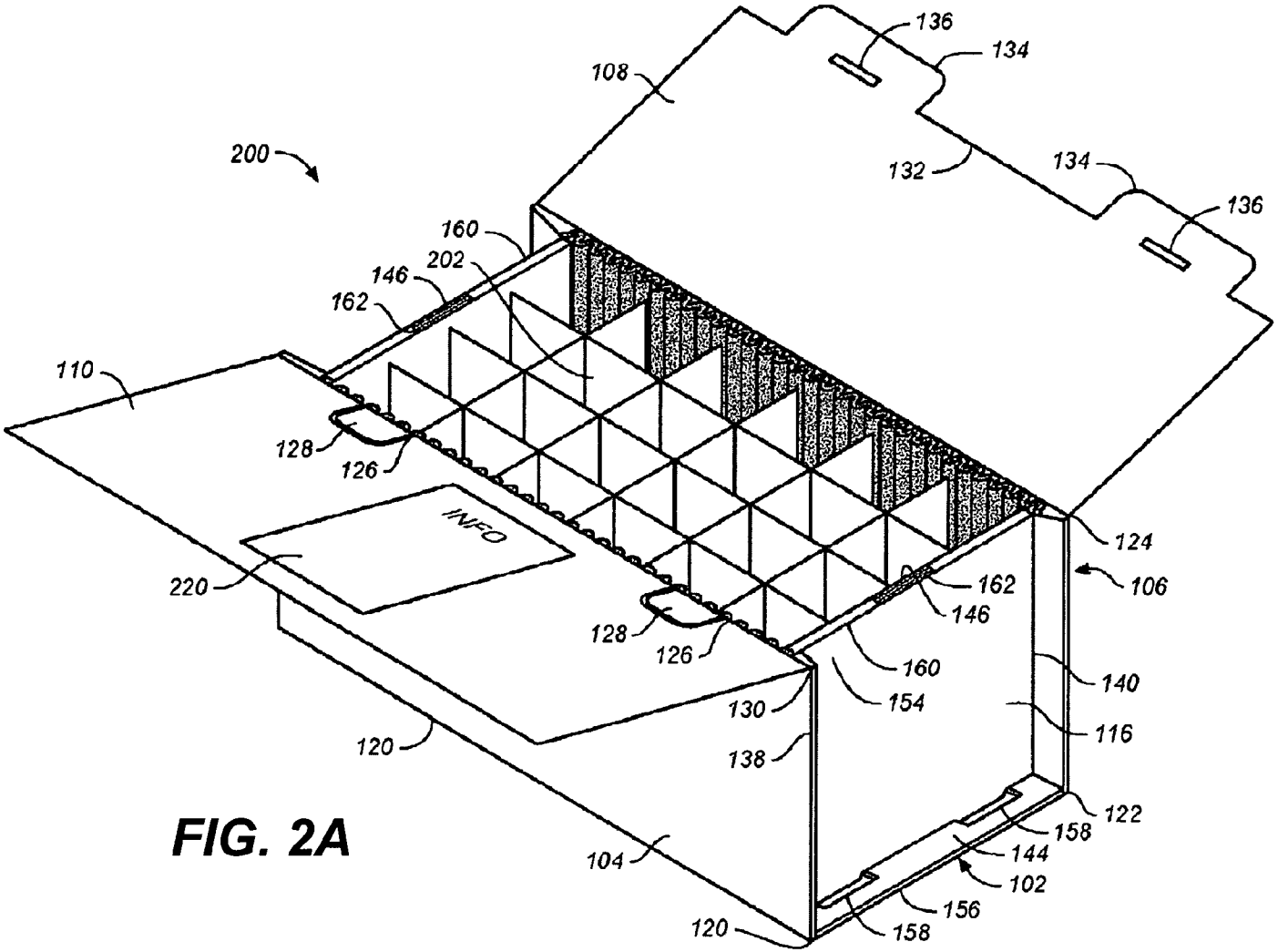
FIG. 2A is diagram of an assembled storage container having a criss-cross insert suitable for receiving fruit, perishables or other objects.

FIG. 2A is diagram of an assembled storage container 200 having a criss-cross insert 202 suitable for receiving fruit, perishables or other objects. As illustrated, assembled storage container 200 has rectangular base 102 having front wall 104 folded upwardly along a folded front edge 120 of the rectangular base 102. A back wall 106 is folded upwardly along a folded back edge 122 of the rectangular base 102. At the top edge 124 of back wall 106 is a pair of cover slots 126 and integral cover secure flaps 128 extended from within cover slot 126.

Also illustrated is outer cover panel 108 to be folded in a spaced and parallel relationship to rectangular base 102 along a folded top edge 130 as an extension to front wall 104. At the top edge 132 of outer cover panel 108 illustrated in FIG. 2 is an example implementation having a pair of tuck flaps 134 with an integral cover secure slots 136 both cooperating with the cover slots 126 and integral cover secure flaps 128 respectively along the top edge 124 of back wall 106.

To strengthen assembled storage container 200 and the cover area, inner cover panel extension 110 is folded along the top edge 124 of back wall 106 forming another layer of material and adding rigidity to the over assembled storage container 200. On the interior facing side of inner cover panel extension 110 can be placed information 220 or advertising as depicted by the printed or mounted information 220 titled "INFO". Both outer cover panel 108 and inner cover panel extension 110 are positioned in a spaced and parallel relationship to rectangular base 102 when assembled storage container 200 is closed.

Ends of assembled storage container 200 are reinforced by a pair of front side panels 112 (not visible in FIG. 2) each extending laterally and inwardly along a doubly scored side edge 138 of front wall 104 and having side panel tab 146 on top edge 148 of each front side panel 112. Further reinforcement to the ends of assembled storage container 200 is provided in a similar manner by a pair of back side panels 114 (not visible in FIG. 2) each extending laterally and inwardly along a doubly scored side edge of back wall 106. Each of back side panels 114 also has a side panel tab 146 on the top edge 154 of each side panel wall 114. Both of the side panel tabs 146 of front side panel 112 and back side panel 114 fit cooperatively into side tab slot 162 positioned between double-scored perforation 160.

A pair of end walls 116 each extends upwardly along a doubly scored side edge 156 of the rectangular base 102. An inset panel 144 having a uniform depth is formed according to a width defined according to an additional scoring 140. The width of inset panel 144 corresponds to a distance between a lower portion of each end wall 116 and just above the side edge 156 of the rectangular base 102 indicated by the additional scoring 140. Likewise, a matching width on the inset panel 144 is defined according to an additional scoring 140 adjacent to a side edge 138 on front side panels 112 and the additional scoring 140 adjacent to a side edge 150 on back side panels 106. By folding double-scored top edge 160 of each end wall 116 inwardly and downwardly around the top end of each end wall 116 and wrapping around front side panels 112 and back side panels 114 greatly increases the overall strength of assembled container 200. For added security, slotted tuck flap 166 (not visible in FIG. 2) is an extension designed with at least one slot 168 to cooperate and lock into the at least one slotted tabs 158 at the lower end of each end wall 116.

Figure 2B:
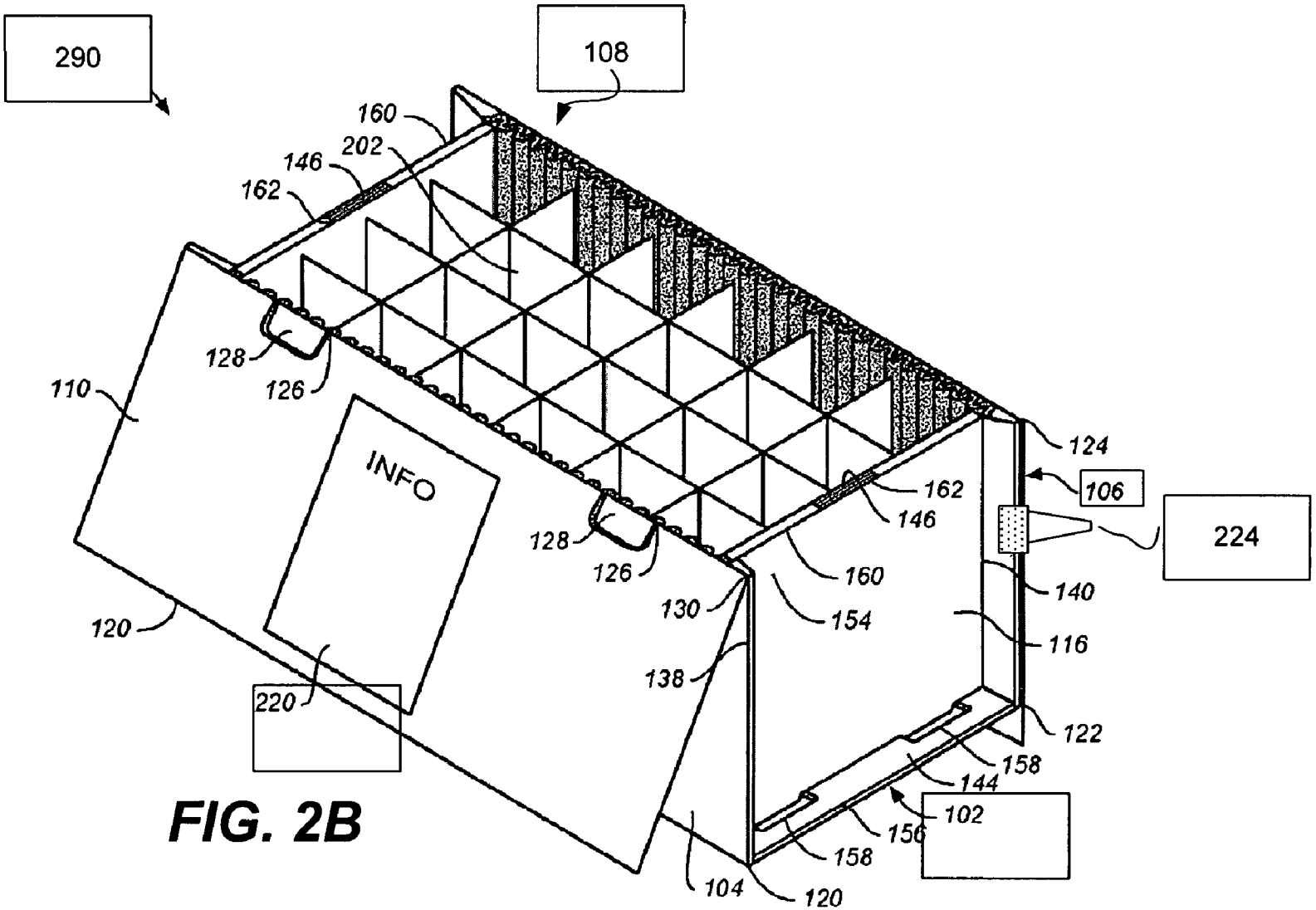
FIG. 2B is diagram of an assembled storage container configured as a display center for fruit, perishables or other objects.

FIG. 2B is diagram of an assembled storage container 290 configured as a display center for fruit, perishables or other objects. Compared with FIG. 2A, assembled storage container 290 has outer cover panel 108 folded in a substantially orthogonal relationship to rectangular base 102. Notably, outer cover panel 108 extends further in distance than back wall 106 and when fixed in place causes assembled storage container 290 to lift at an angle along rectangular base 102. Fasteners 224 keep outer cover panel 108 in position and at a slight to moderate angle. For example, one type of fastener 224 can be implemented using one or more conventional binder clips attached onto the cardboard back wall 106 and outer cover panel 108. This makes it easier to view and select items from assembled storage container 290. For example, a person can more readily view and select fruit from assembled storage container 290 when it is configured as a display center for the fruit. In addition, information 220 is also displayed making it useful to provide information about the items in assembled storage container 290 or provide certain advertising related to the items or of particular interest to the recipient of assembled storage container 290.

Figure 3:
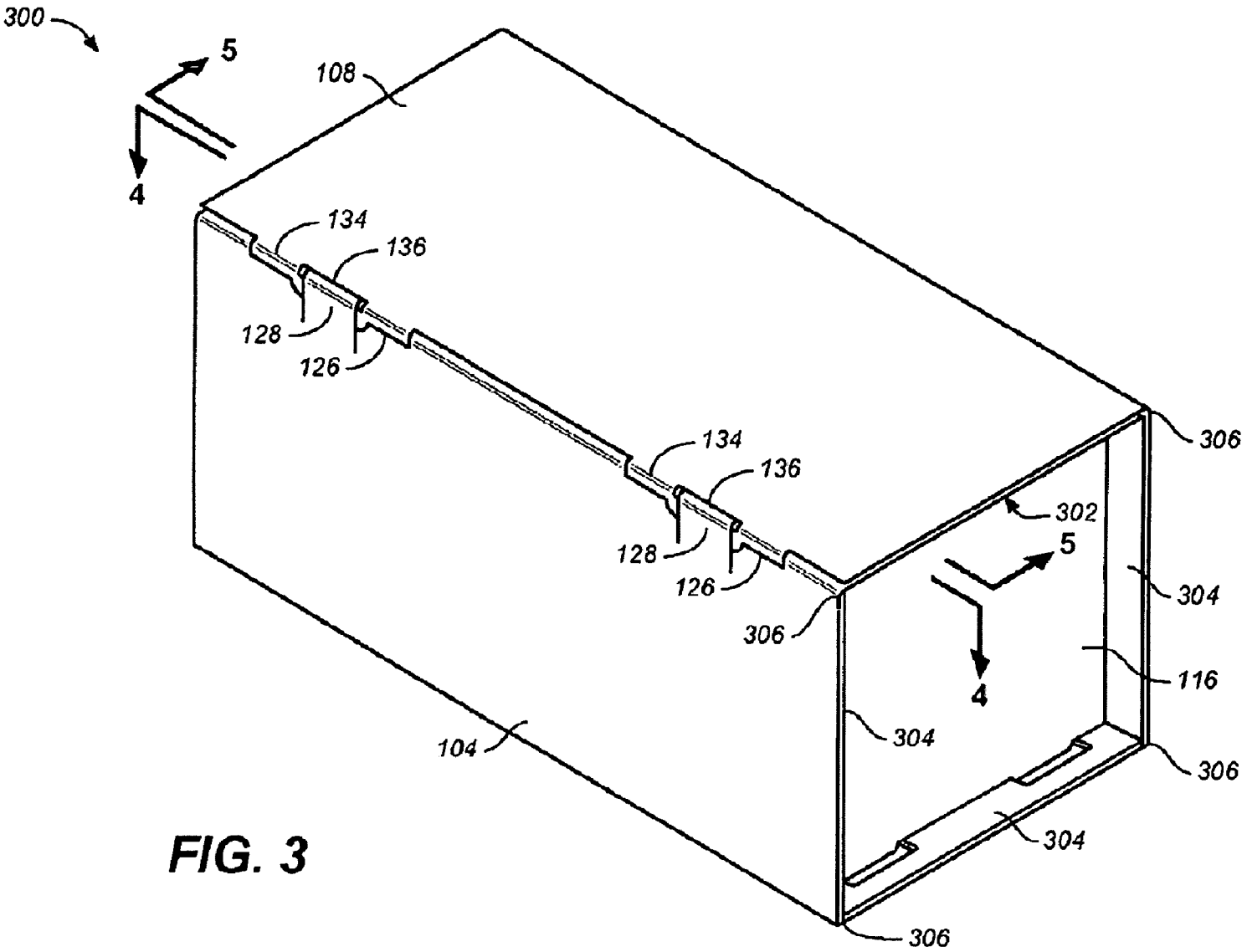
FIG. 3 depicts a fully assembled and closed storage container designed in accordance with one implementation of the present invention.

FIG. 3 depicts a fully assembled and closed storage container 300 designed in accordance with one implementation of the present invention. Closed storage container 300 depicted in FIG. 3 illustrates outer cover panel 108 secured in place by a pair of cover tuck flaps 134 inserted into pair of cover slots 126 and integral cover secure flaps 128 inserted into integral cover secure slots 136. This arrangement facilitates keeping closed storage container 300 in a secure arrangement for shipping and handling.

Top portion of end walls 116 wrapping around front side panels 112 (not visible in FIG. 3) and back side panels 114 (not visible in FIG. 3) combined with outer cover panel 108 and inner cover panel 110 make a convenient and strong handle 302 for lifting closed storage container 300. In addition, this arrangement also provides for crush corners 306 that protect contents from various forces that may occur during shipping of handling of closed storage container 300. As a purely aesthetic feature, edging 304 on the sides and bottom portions creates a recognizable overall appearance in both the closed storage container 300 as well as in the assembled yet opened storage container 200 in FIG. 2.

Figure 4:
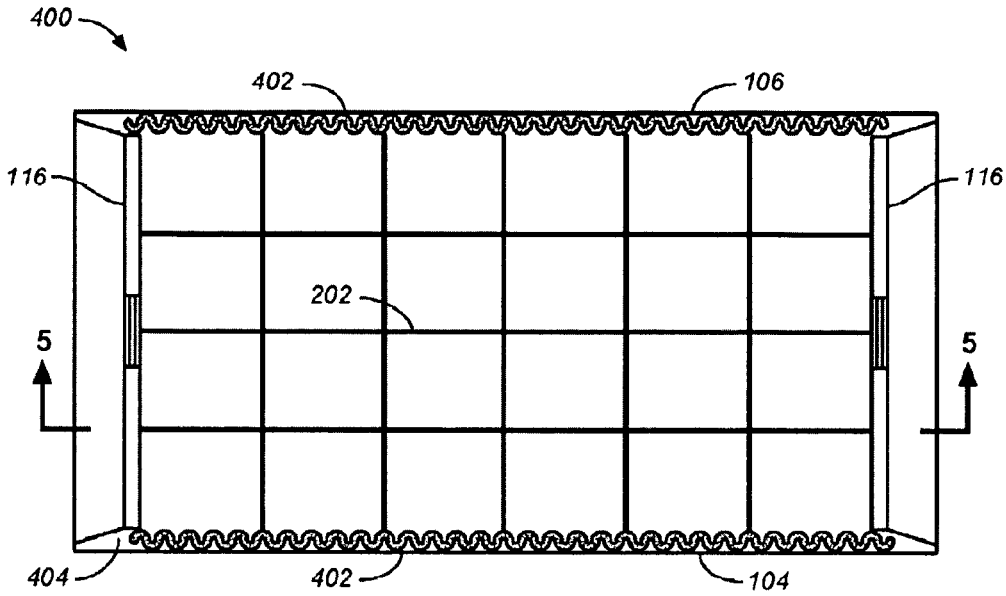
FIG. 4 depicts a storage container from a top-view having criss-cross inserts and packing material.

FIG. 4 depicts a storage container 400 from a top-view (see lines 4-4 in FIG. 2) having criss-cross inserts 202 and packing material 402. As previously described, criss-cross inserts 202 can be used to pack fruits and other perishables that may fit in the spaces formed by the intersection of the slats of cardboard or other materials. These criss-cross inserts 202 serve to keep the items being shipped in place and from hitting each other as well as provide some protection from mechanical shock to the overall storage container 400. Similarly, packing material 402 is placed on sides to increase resistance to mechanical shock applied to outside faces of the box. For example, packing material 402 can be a biodegradable cushioning material derived from corn starch or other similar materials. Alternatively, it can be constructed from paper or, if necessary, lesser biodegradable petrochemical derived materials.

Gap 404 is formed from an angular recess of end walls 116 along with back wall 104 and front wall 106 that receives packing material 402. Together, the placement of packing material 402 into gap 404 causes a firm packing of items in storage container 400 when it is closed as the packing material 402 is compressed against back wall 104 and front wall 106. While packing material 402 can also be placed flatly across criss-cross inserts 202, it has been omitted to allow viewing the interior of storage container 400.

Figure 5:
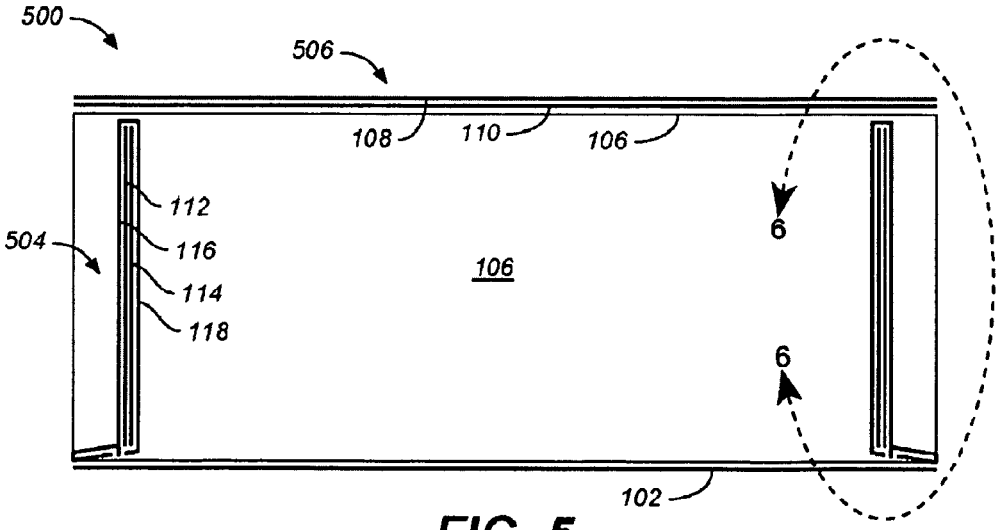
FIG. 5 is a storage container from a side view depicting the folding of multiple cardboard sheets and increased strength in the storage container.
Figure 6:
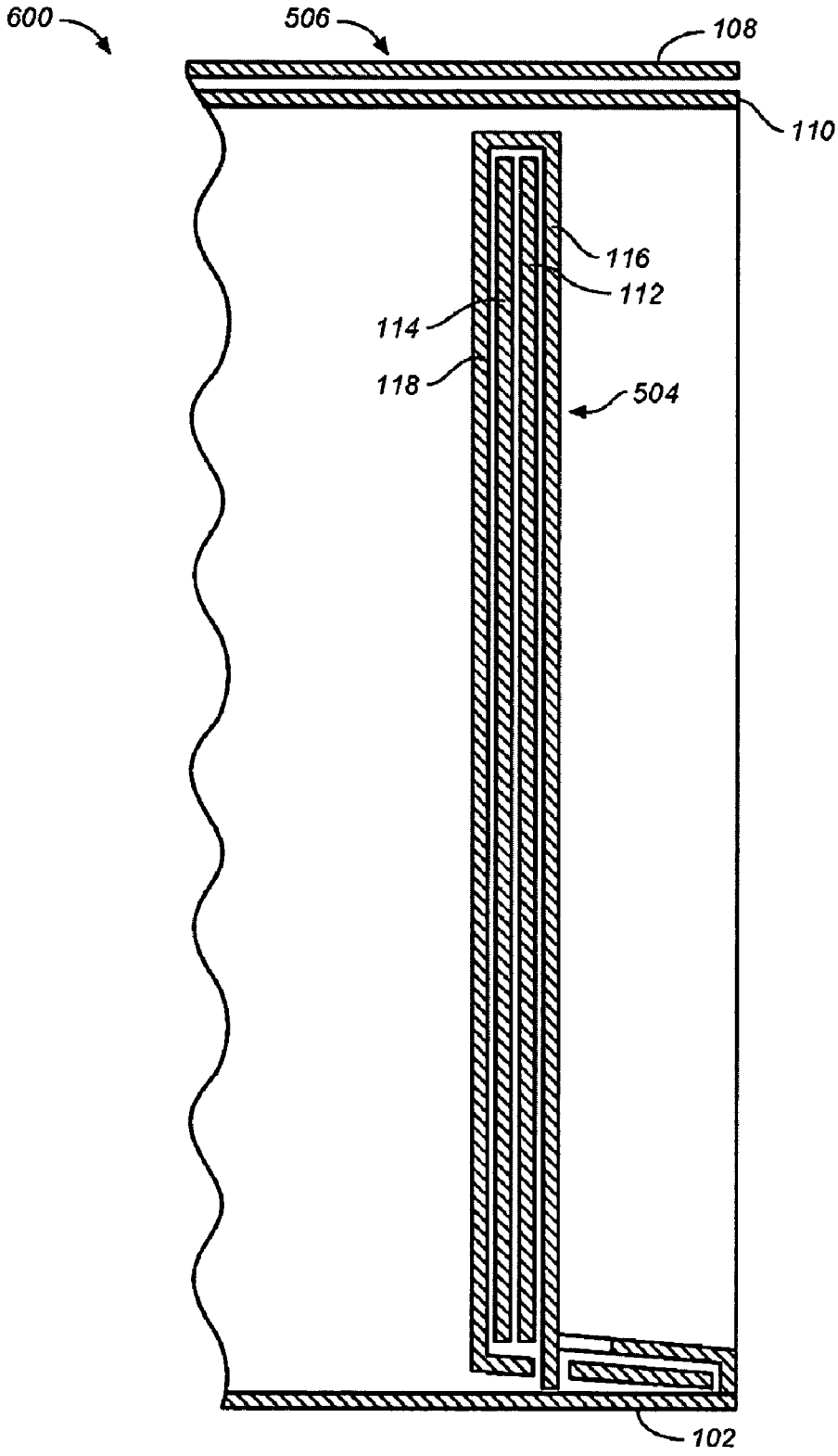
FIG. 6 is a detail of storage container from a side view demonstrating the composite ends and a composite cover.

FIG. 5 is a storage container 500 side view (see line 5-5 in FIG. 2) depicting the folding of multiple cardboard sheets and increased strength in the storage container 500. In the example illustration, composite ends 504 of storage container are formed from end wall 116 and inner end walls 118 both folded inwardly and downwardly around the top end of each end wall 116 and wrapping around back side panels 112 and front side panels 114. Composite cover 506 includes a layering of both outer cover panel 108 and inner cover panel extension 110 in a spaced and parallel relationship to rectangular base 102 when storage container 500 is closed FIG. 6 is a detail of storage container 600 side view (see line 6-6 in FIG. 5) demonstrating the composite ends 504 and composite cover 506. From the detail side view, composite ends 504 of storage container are formed from end wall 116 and inner end walls 118 both folded inwardly and downwardly around the top end of each end wall 116 and wrapping around back side panels 112 and front side panels 114. Composite cover 506 includes a layering of both outer cover panel 108 and inner cover panel 110 in a spaced and parallel relationship to rectangular base 102 when storage container 600 is closed While specific embodiments have been described herein for purposes of illustration, various modifications may be made without departing from the spirit and scope of the invention. Accordingly, the invention is not limited to the above-described implementations, but instead is defined by the appended claims in light of their full scope of equivalents.

What is claimed is:

1. A storage container formed from cardboard material, comprising:

a rectangular base unit having a front wall folded upwardly along a folded front edge of the rectangular base, a back wall folded upwardly along a folded back edge of the rectangular base with at least one cover slot and integral cover secure flap extending from within the at least one cover slot;

a outer cover panel extension to the front wall folded in a spaced and parallel relationship to the rectangular base along a folded top edge of the front wall and having at least one cover tuck flap with an integral cover secure slot both cooperating with the at least one cover slot and integral cover secure flap respectively;

an inner cover panel extension to the back wall folded along a folded top edge of the back wall in a spaced and parallel relationship to the rectangular base and directly under the outer cover panel;

a pair of front side panels each extending laterally and inwardly along a scored side edge of the front wall and having side panel tab on the top edge of each front side panel;

a pair of back side panels each extending laterally and inwardly along a scored side edge of the back wall and having side panel tab on the top edge of each back side panel;

a pair of end walls each extending upwardly along a scored side edge of the rectangular base, each end wall having at least one slotted tab at the lower end of each end wall and an inner end wall extending along a double-scored top edge of each end wall folded inwardly and downwardly around the top end of each end wall and wrapping around a front side panel and a back side panel while having a slotted tuck flap extension designed with at least one slot to cooperate and lock into the at least one slotted tab at the lower end of each end wall;

an inset panel having a depth formed according to a width defined according to an additional scoring formed between a lower portion of each end wall and above the side edge of the rectangular base and a matching width defined according to an additional scoring on a side edge of each side panel adjacent to the side edges of the front wall and back wall.

2. The container of claim 1 further comprising:

a side tab slot in the gap there between the double-scored top edge of each end wall fitted cooperatively with the side panel tab of the front side panel and the side panel tab of back side panel.

3. The container of claim 1 wherein a top portion formed from the inset of the end walls wrapping around front side panels and back side panels combined with outer cover panel and inner cover panel make a convenient and strong handle for lifting the container.

4. The container of claim 1 wherein the cover panel is positioned in an orthogonal relationship to the rectangular base rather than a spaced and parallel relationship to the rectangular base and extends downward farther in distance than the back wall to lift the storage container at an angle along the rectangular base.

5. The container of claim 1 further comprising:

a criss-cross insert having bays for receiving one or more fruits potentially of different sizes and formed from the intersection of one or more first cardboard slats running along the interior length and one or more second cardboard slats running along the interior width of the rectangular base with slots coincident with the intersections and filled to each slat.

* * * * *